US010965019B1

(12) United States Patent
Novin et al.

(10) Patent No.: US 10,965,019 B1
(45) Date of Patent: Mar. 30, 2021

(54) WIRELESS TRANSCEIVER FOR CONTROLLING PROFESSIONAL LIGHTS AND SPECIAL EFFECTS DEVICES

(71) Applicant: Innovative Dimmers, LLC, Van Nuys, CA (US)

(72) Inventors: Wade Novin, Sherman Oaks, CA (US); Eli Novin, San Jose, CA (US); Craig Brink, Van Nuys, CA (US); Adam Knapp, Van Nuys, CA (US); Robert Nino, Van Nuys, CA (US)

(73) Assignee: Innovative Dimmers, LLC, Van Nuys, CA (US)

( * ) Notice: Subject to any disclaimer, the term of this patent is extended or adjusted under 35 U.S.C. 154(b) by 0 days.

(21) Appl. No.: 15/960,525

(22) Filed: Apr. 23, 2018

Related U.S. Application Data

(60) Provisional application No. 62/488,850, filed on Apr. 23, 2017.

(51) Int. Cl.
*H05B 47/19* (2020.01)
*H01Q 1/50* (2006.01)
*H01Q 1/24* (2006.01)

(52) U.S. Cl.
CPC ..... *H01Q 1/50* (2013.01); *H01Q 1/244* (2013.01); *H05B 47/19* (2020.01)

(58) Field of Classification Search
CPC ..... H01Q 1/244; H01Q 1/50; H01Q 1/12; H01Q 1/1264; H05B 37/0245; H05B 37/0272; H05B 45/10; H05B 47/10; H05B 47/175; H05B 47/19
See application file for complete search history.

(56) References Cited

U.S. PATENT DOCUMENTS

| | | | | |
|---|---|---|---|---|
| D167,828 | S | 5/1952 | Florac | |
| D176,480 | S | 12/1955 | Petertil | |
| D205,073 | S | 6/1966 | Shimazaki | |
| D210,773 | S | 4/1968 | Komata et al. | |
| D236,990 | S | 9/1975 | Lewis | |
| 4,220,955 | A | 9/1980 | Frye | |
| 4,257,121 | A | 3/1981 | Henderson et al. | |
| D272,737 | S | 2/1984 | Coons et al. | |
| 4,528,566 | A | 7/1985 | Tyler | |
| D282,661 | S | 2/1986 | Imazeki | |
| 4,859,922 | A * | 8/1989 | Tauchenitz | G05G 1/10 318/628 |
| 4,958,382 | A | 9/1990 | Imanishi | |
| D311,536 | S | 10/1990 | Reeves et al. | |

(Continued)

*Primary Examiner* — Jason Crawford
(74) *Attorney, Agent, or Firm* — Fredrikson & Byron, P.A.

(57) ABSTRACT

This invention provides a wireless transceiver device for retrofit conversion of non-wireless enabled electronic controllers and controlled host devices. This invention allows for the rotating of the wireless transceiver device allowing for the entire device to rotate around the connector axis. This functionality allows for the ability to rotate the wireless transceiver device 360 degrees or to any orientation that maximizes the available space around the host device or around the area of permanent or temporary installations of networks of single or multiple controllers and controlled devices. The inclusion of a stop pin washer plate may be combined with a rotation limiting washer to prevent the rotating assembly from moving freely around the 360 degrees of rotation.

9 Claims, 9 Drawing Sheets

(56) References Cited

U.S. PATENT DOCUMENTS 5,024,414 A 6/1991 Drain
D348,664 S 7/1994 Imazeki
5,446,789 A 8/1995 Loy et al.
5,606,733 A 2/1997 Kanayama et al.
5,652,578 A * 7/1997 Snow ..... G01S 1/68 340/539.1
D387,765 S 12/1997 Brassard
D388,005 S 12/1997 Henderson
5,710,987 A 1/1998 Paulick
5,999,821 A 12/1999 Kaschke
6,211,830 B1 4/2001 Matsuyoshi et al.
D478,577 S 8/2003 Kolls et al.
8,441,433 B2 * 5/2013 Olien ..... G06F 3/016 345/156
9,080,782 B1 7/2015 Sheikh
9,713,231 B2 * 7/2017 Kelly ..... H05B 47/105
10,745,939 B2 * 8/2020 Coleman ..... H02K 35/02
2001/0012768 A1 8/2001 Odachi et al.
2002/0036592 A1 3/2002 Sekine et al.
2002/0193137 A1 12/2002 Bank et al.
2004/0032395 A1 * 2/2004 Goldenberg ..... G06F 3/0485 345/156
2008/0136660 A1 * 6/2008 Bailey ..... H05B 45/50 340/815.45
2008/0165999 A1 7/2008 Dinh et al.
2008/0176609 A1 7/2008 Kim et al.
2008/0316133 A1 * 12/2008 Guixa Arderiu ..... H01Q 3/02 343/766
2009/0001232 A1 1/2009 Seo et al.
2009/0206769 A1 * 8/2009 Biery ..... H05B 41/3921 315/291
2010/0280677 A1 * 11/2010 Budike, Jr. ..... H05B 47/19 700/296
2011/0006877 A1 * 1/2011 Franklin ..... H04B 10/1141 340/3.9
2011/0098831 A1 * 4/2011 Diehl ..... F21V 23/04 700/90
2012/0148992 A1 6/2012 Quail
2014/0056010 A1 * 2/2014 Devlin ..... F21V 23/0435 362/418
2014/0117859 A1 * 5/2014 Swatsky ..... H05B 47/19 315/158
2014/0132115 A1 5/2014 Fujii et al.
2014/0265918 A1 * 9/2014 Cummings ..... H05B 47/19 315/292
2014/0335910 A1 * 11/2014 Wang ..... H05B 47/16 455/550.1
2015/0373796 A1 * 12/2015 Bahrehmand ..... H05B 45/37 315/129
2016/0007431 A1 * 1/2016 Bosua ..... H05B 45/20 315/158
2016/0323972 A1 * 11/2016 Bora ..... F21V 7/00
2017/0027041 A1 1/2017 Sekiyama
2017/0055135 A1 2/2017 Jimenez et al.
2017/0280533 A1 * 9/2017 Dimberg ..... G01D 5/20
2018/0026358 A1 * 1/2018 Johnson ..... H01Q 1/06 343/702
2018/0184504 A1 * 6/2018 Van De Sluis ..... H05B 47/175
2019/0107895 A1 * 4/2019 Steinman ..... G06F 3/017

* cited by examiner

WIRELESS TRANSCEIVER FOR CONTROLLING PROFESSIONAL LIGHTS AND SPECIAL EFFECTS DEVICES

BACKGROUND OF THE INVENTION

1. Field of the Invention

This invention provides a wireless transceiver device for controlling professional stage and movie lighting and effects. Specifically, this invention enables the control of professional lighting equipment and effects with a wireless transceiver device that can be connected to the lights or effects equipment and controlled by a wireless controller system.

2. Related Art

The majority of professional stage and studio lighting and effects control use the DMX512 (or DMX) digital communications signaling protocol standard. It is the primary communication protocol connecting lighting and effects controllers to the controlled lighting dimmer or effects systems. The popularity of the standard has resulted in expanded use into interior commercial and residential lighting as well.

Currently, traditional DMX based control and controlled systems (host devices) require a physical cabling connection between the controller to each controlled device, e.g. lighting dimmer or effects system. The network topology of DMX provides for a unique address for each device in the network. Further, DMX allows the network cabling to 'pass-thru' or daisy chain devices together in a series of cabling segments. Ultimately, however, the DMX network still requires a cable connection at each controller and controlled device. This need for cabling infrastructure may significantly increase the cost and complexity of DMX device applications, particularly in temporary setups such as those used in live-action film studio, on-set or on-location situations. In these cases a complex and costly cabled network is setup and may only be used for hours or days, yet still it needs to be properly installed, labeled, configured and uninstalled. The standardization of end connectors used for DMX signal networks in host devices limits the orientation and placement of such cables in both temporary and permanent cabling installations.

The invention addresses the cabling requirement for DMX controller to controlled device signaling. A suitable replacement for cabling infrastructure is a wireless based signaling system. Such a system must maintain full compatibility with DMX protocols, topology and physical connectivity without any changes to the host device. Further, the system must adhere to standard wireless networking protocols, topologies and physical connectivity including meeting interference and emissions limitations. Finally, the connectivity to host devices must not interfere physically with the intended use of the device and any of its operating or mounting interfaces. Functionally, the invention must operate the DMX signaling on controller and controlled host devices in a manner indistinguishable from the legacy cable network.

A need exists for a wireless transceiver that can communicate with lighting systems and special erects devices and controlled by a user to make changes to the devices in a cost efficient and operator friendly environment.

SUMMARY

This invention provides a wireless transceiver device for retrofit conversion of non-wireless enabled electronic controllers and controlled host devices. The invention is compatible with standard network protocols and physical connectivity through standard connectors and cabling. Further, it uses standard wireless networking protocols, frequencies and physical connectivity to broadcast signals wirelessly to and from controllers to controlled devices.

In addition, the invention includes the feature of a rotating the wireless transceiver device allowing for the entire device to rotate around the connector axis. This provides capability to rotate the device to any orientation that maximizes the available space around the host device or around the area of permanent or temporary installations of networks of single or multiple controllers and controlled devices.

The control signals are converted and distributed to and from controlled devices via a wireless radio frequency transmitter, receiver or transceiver and an antenna. The wireless subsystem may be encrypted and may employ intelligent frequency hopping and other error correction techniques. The invention connects to standard interface connectors already present on existing host controllers and devices and includes the additional function of a rotating connector assembly. The rotating connector assembly allows the wireless transceiver device to rotate around the axis of the wireless transceiver device. This rotating function provides for optimal positioning and maximum compatibility with existing devices used in both permanent and temporary installations of device networks.

The wireless transceiver device includes indicators in a screen or lights that provides a user the status of the wireless network link and activity, wireless signal strength, DMX signal activity, battery power strength or connection to external power. Further, there may be switches, buttons or dials used to activate power, reset the wireless link, unlink the wireless connection or set channels.

The wireless transceiver device may be equipped with network software and hardware that supports remote network services and allows for remote connectivity to allow a user to monitor pertinent status information and control the device. This information is transmitted wirelessly using a network protocol such as IP, RFID, HTTP, HTTPS or other suitable network protocol for remote monitoring and logging.

Other systems, methods, features, and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DETAILED DESCRIPTION OF THE DRAWINGS

The components in the figures are not necessarily to scale, emphasis being placed instead upon illustrating the principles of the invention. In the figures, like reference numerals designate corresponding parts throughout the different views.

DETAILED DESCRIPTION

Figure 1:
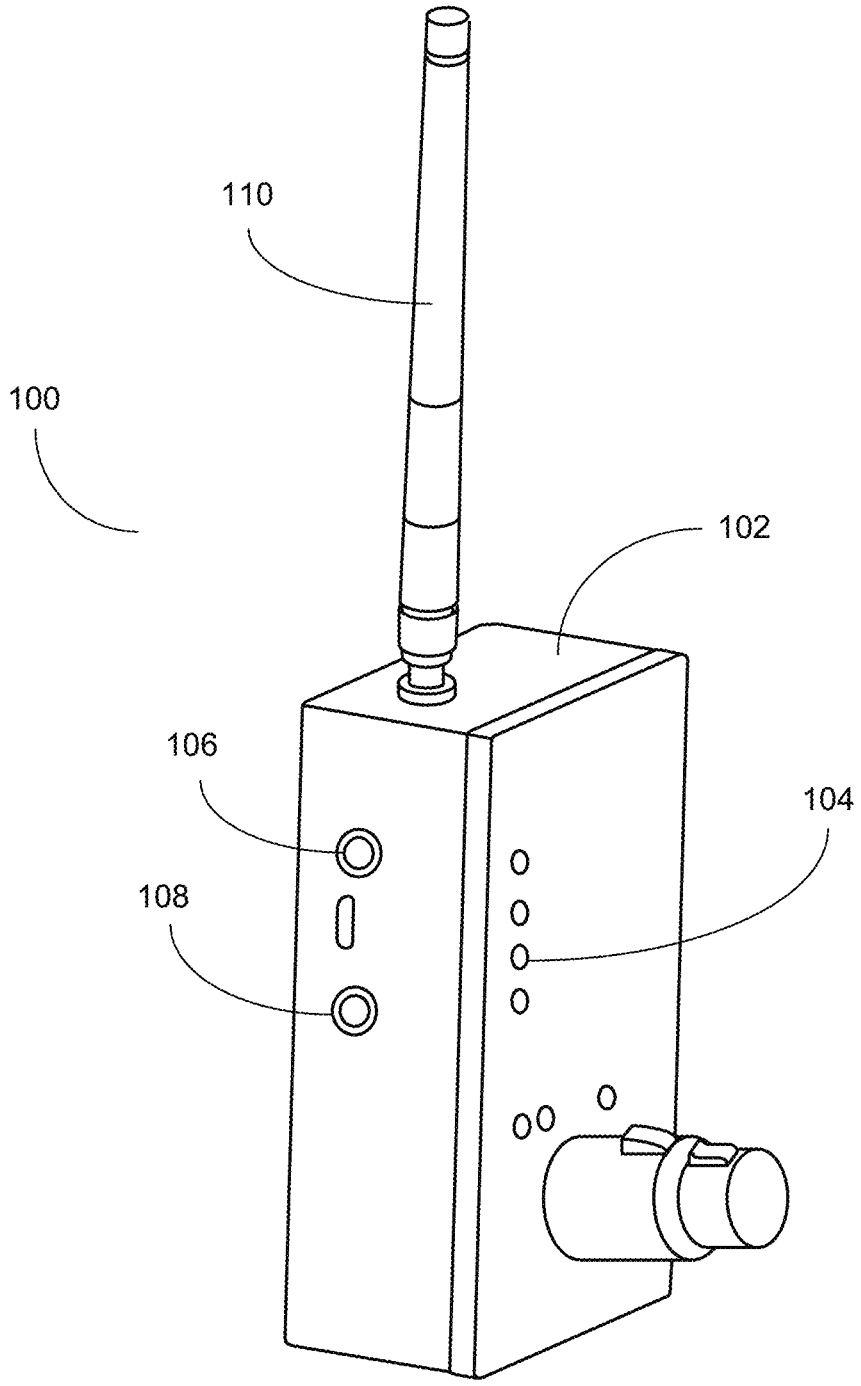
FIG. 1 is a perspective rear view of the wireless transceiver device for controlling professional stage and movie lighting and effects.

FIG. 1 is a perspective rear view of the wireless transceiver device 100 for controlling professional stage and movie lighting and effects. The wireless transceiver device 100 has a rigid case or chassis 102 for containing the internal components and circuit board assemblies while also providing a case for holding visual external indicators 104, switches 106 and 108 and antenna 110. The wireless transceiver device 100 may include an LCD screen or other visual display screen (not shown).

The wireless transceiver device 100 can operate on any practical wireless protocol (e.g., WiFi, CRMX, W-DMX, Ethernet, Bluetooth, Zigbee and/or near field RFID. However, in its most practical application, the wireless transceiver device 100 typically operates using the DMX512 wireless protocol standard that is commonly used to control stage lighting and special effects devices. The signals transmitted via the wireless protocol can be encrypted for added security so that intentional or un-intentional interference in the wireless transceiver device's operation is minimized. The wireless transceiver device 100 can convert any controlled lighting device or special effects device into a wireless device that can be controlled by a controller. Using DMX512, the range can be up to a quarter mile and may employ frequency hopping to reduce interference and provide a certain level of security.

The wireless transceiver device 100 comprises internal electronic components further comprising a radio frequency ("RF") module that allows the wireless transceiver device 100 to act as a receiver, transmitter or a transceiver. The wireless transceiver device 100 can employ the functionality of a receiver, transmitter or a transceiver with user controlled switches allowing for the user to select its mode of operation.

Figure 2:
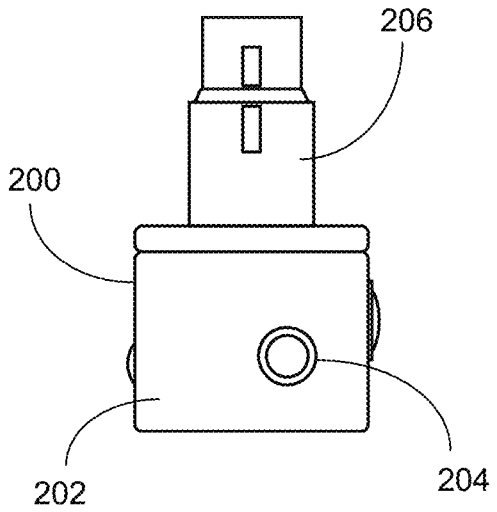
FIG. 2 is a top view of the wireless transceiver device for controlling professional stage and movie lighting and effects.

FIG. 2 is a top view of the wireless transceiver device 200 for controlling professional stage and movie lighting and effects. The wireless transceiver device 200 has housing or chassis 202 and an antenna 204. An adaptor 206 can be attached to the housing or chassis 202 and can provide power to the wireless transceiver device 200. Both power and data can be sent through a cable connection that attaches to the adaptor 206.

Figure 3:
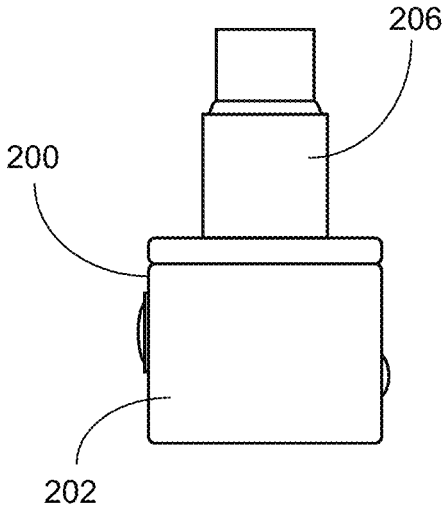
FIG. 3 is a bottom view of the wireless transceiver device for controlling professional stage and movie lighting and effects.

FIG. 3 is a bottom view of the wireless transceiver device 200 for controlling professional stage and movie lighting and effects. The adaptor 206 can be shown protruding from the rear of the housing or chassis 202.

Figure 4:
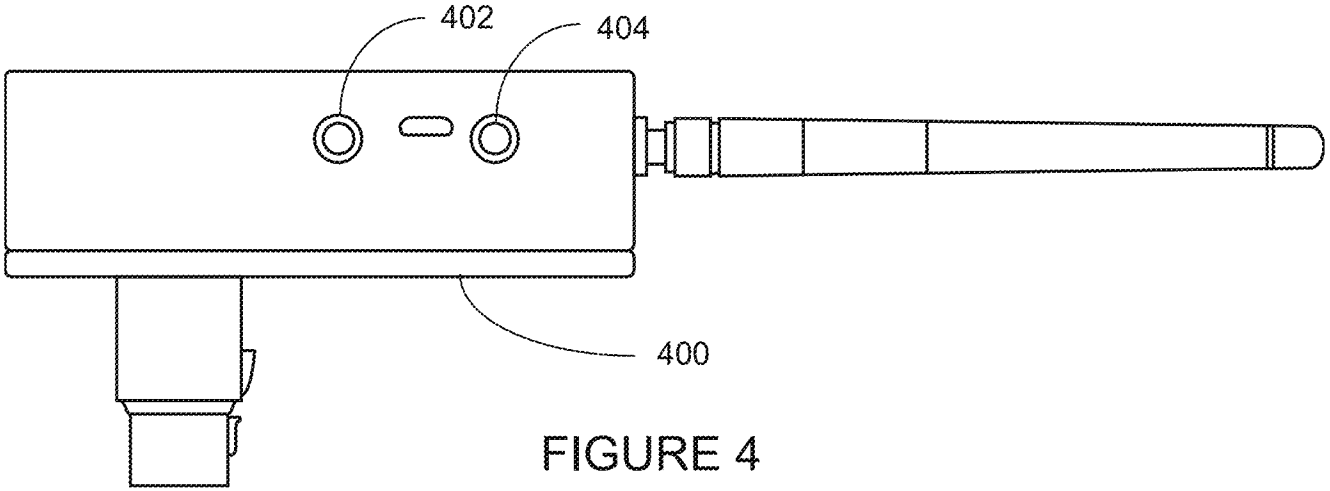
FIG. 4 is a right side view of the wireless transceiver device for controlling professional stage and movie lighting and effects.

FIG. 4 is a right side view of the wireless transceiver device 400 for controlling professional stage and movie lighting and effects. Switches and/or buttons 402 and 404 can be used to provide user controlled hard wired controls that alter the functionality of the wireless transceiver device 400.

Figure 5:
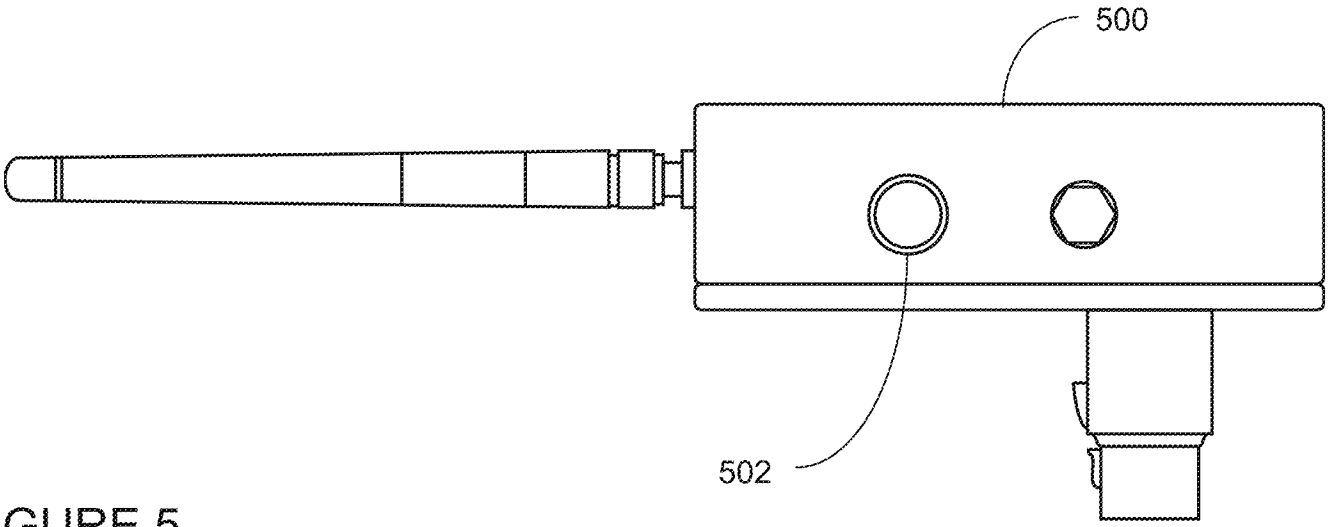
FIG. 5 is a left side view of the wireless transceiver device for controlling professional stage and movie lighting and effects.

FIG. 5 is a left side view of the wireless transceiver device for controlling professional stage and movie lighting and effects. A user interface can be implemented that unlinks the wireless network. This interface may be implemented using a graphical user interface on a software driven dashboard or a physical hardware switch 140. This unlink function can reset the wireless connection and the internal circuitry of the wireless transceiver device 500 will attempt to reconnect using standard wireless connectivity protocol standards.

Figure 6:
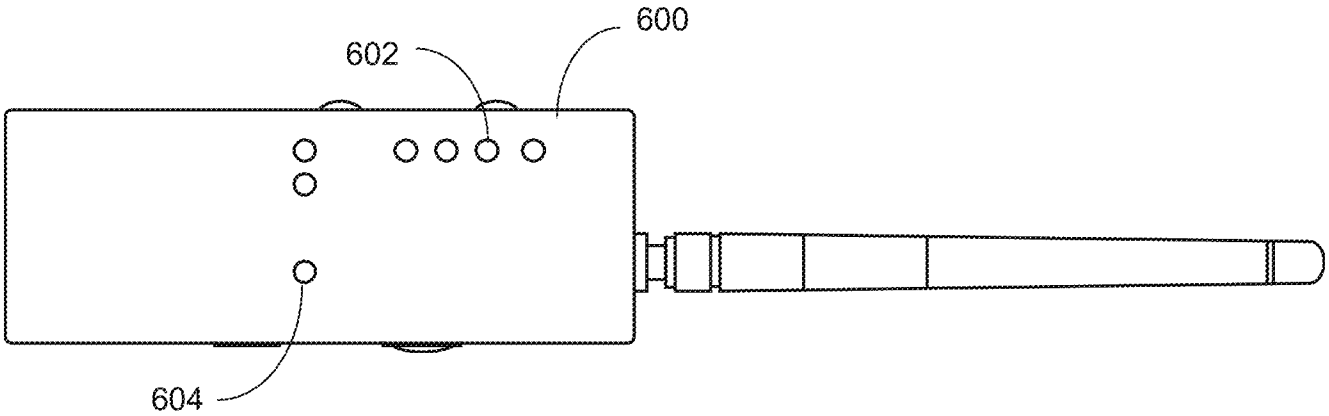
FIG. 6 is a front view of the wireless transceiver device for controlling professional stage and movie lighting and effects.

FIG. 6 is a front view of the wireless transceiver device 600 for controlling professional stage and movie lighting and effects. Visual lights such as LED lights 602 and 604 can provide visual cues to the user regarding the proper functioning of the wireless transceiver device 600. These visual cues can include the status of the wireless connection 602, the amount of power remaining in the battery 604, whether signal strength, signal integrity, cross-talk, channel blocking, interference or noise, system faults, etc.

Figure 7:
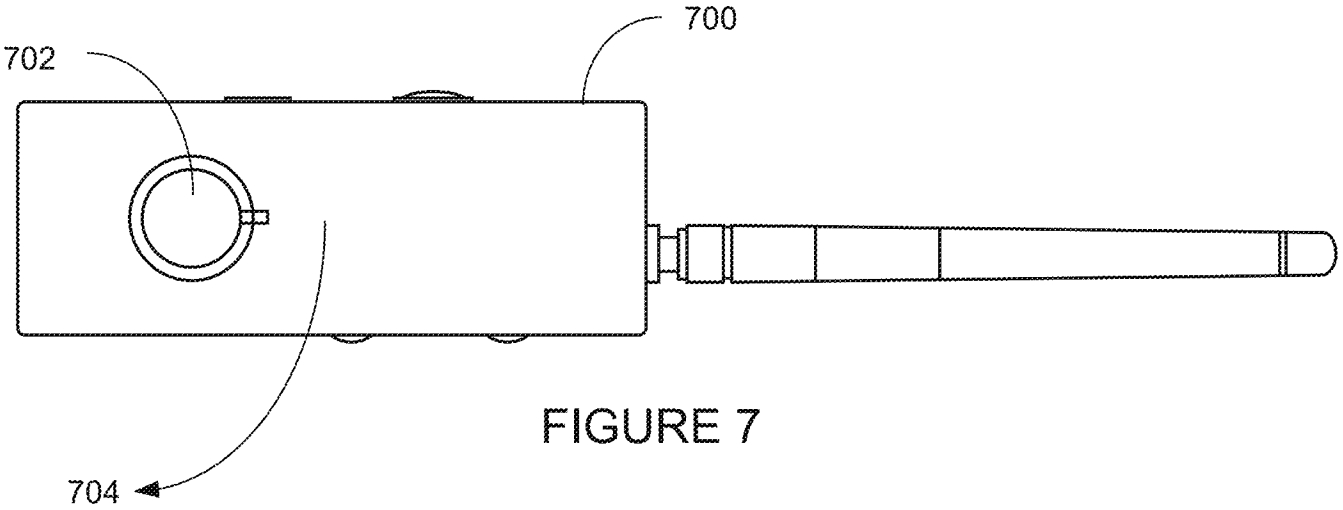
FIG. 7 is a rear view of the wireless transceiver device for controlling professional stage and movie lighting and effects.

FIG. 7 is a rear view of the wireless transceiver device 700 for controlling professional stage and movie lighting and effects. The adaptor 702 may be constructed that supports and allows the wireless transceiver device 700 to rotate 704 around the axis of the adaptor 702.

Figure 8:
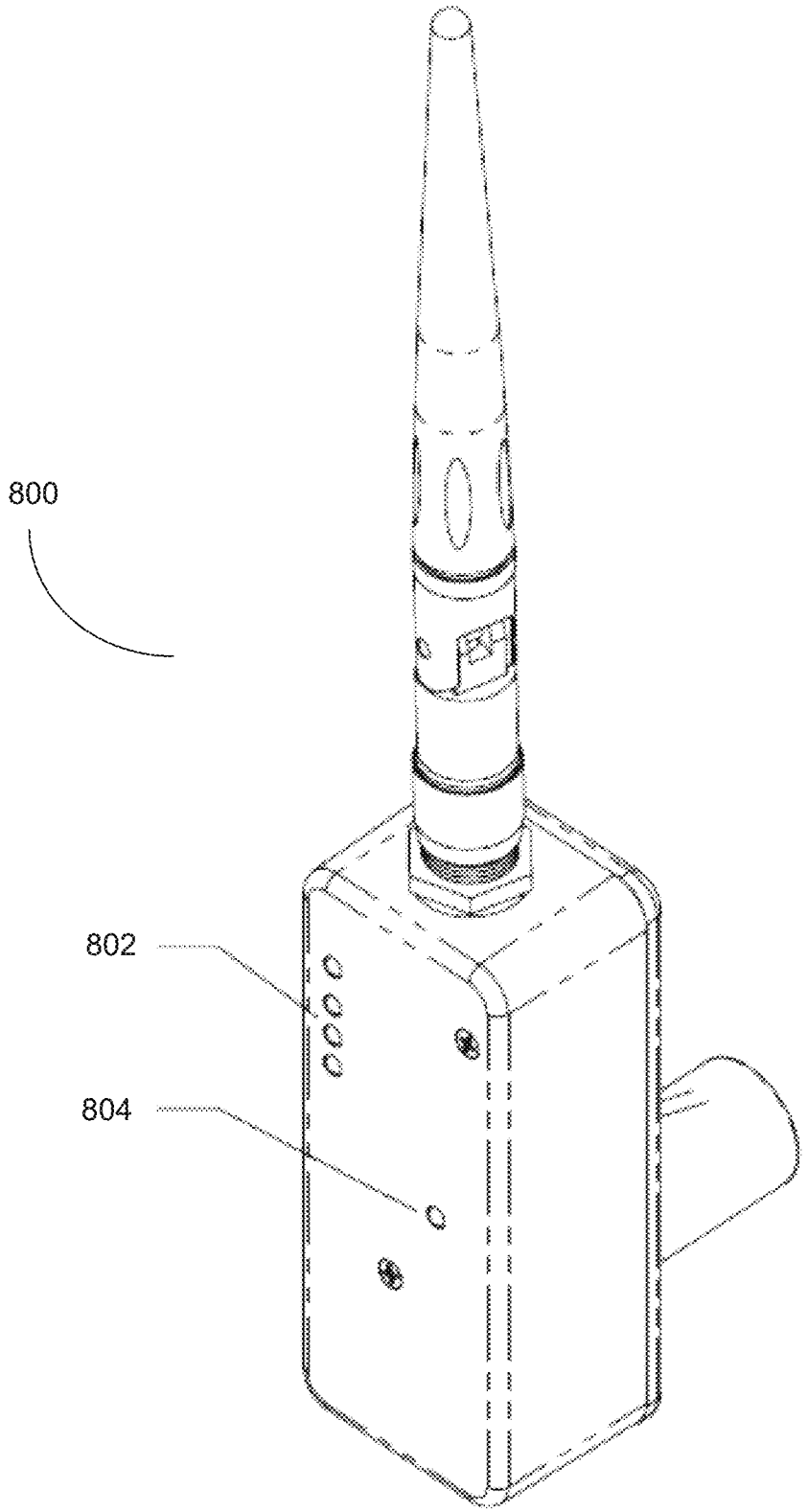
FIG. 8 is a perspective front view of the wireless transceiver device for controlling professional stage and movie lighting and effects.

FIG. 8 is a perspective front view of the wireless transceiver device 800 for controlling professional stage and movie lighting and effects. Visual indicator lights 802 can provide the radio frequency ("RF") signal strength and status indicators while the light 804 can provide a visual indicator of the power of device or the amount of battery remaining. Additional variations of the visual indicators are the use of different colored LED lights (e.g., red, yellow and green) as well as steady on or flashing indications to provide additional feedback to the user regarding the device's operational status.

Figure 9:
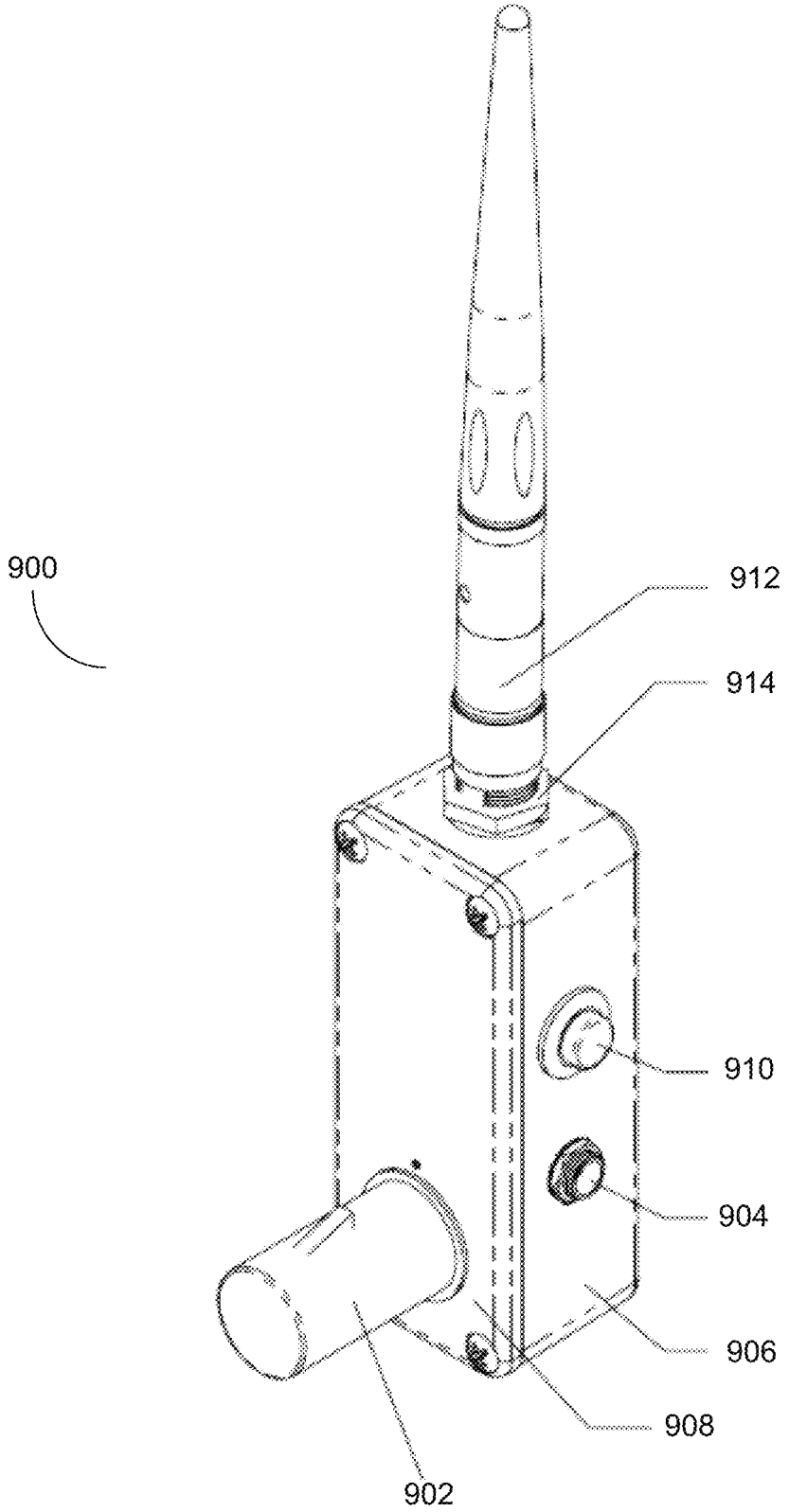
FIG. 9 is a perspective rear view of the wireless transceiver device for controlling professional stage and movie lighting and effects.

FIG. 9 is a perspective rear view of the wireless transceiver device 900 with an adaptor 902 for controlling professional stage and movie lighting and effects. An external DC power connector 904 may be mounted to the chassis 906 or cover 908. The chassis 906 can be fitted with a chassis cover 908 to prevent damage or interference with internal components that do not require user accessibility for operation. The power connector can facilitate the connection of an external AC power source to a direct current ("DC") transformer power source which is used by the internal circuit board assembly. Various embodiments can accept voltages from a USB style adapter or by any plug in transformers adapter that is well known in the art. The power voltage ranges can vary from 4 volts to 48 volts. An alternate embodiment may include an internal power source supplied by batteries, solar power cells, or a connector for receiving power from the host device, Power over Ethernet ("PoE") or other wireless power source, and/or power supplied through unused connector pins on the DMX connector.

The wireless transceiver device 900 may also employ a wireless unlink or wireless disconnect button 910 that can be used to reset the device 900 to a standard wireless protocol established by the manufacturer or pre-selected by the user. Antenna 912 is connected to the wireless transceiver device 900 by connector 914.

Figure 10:
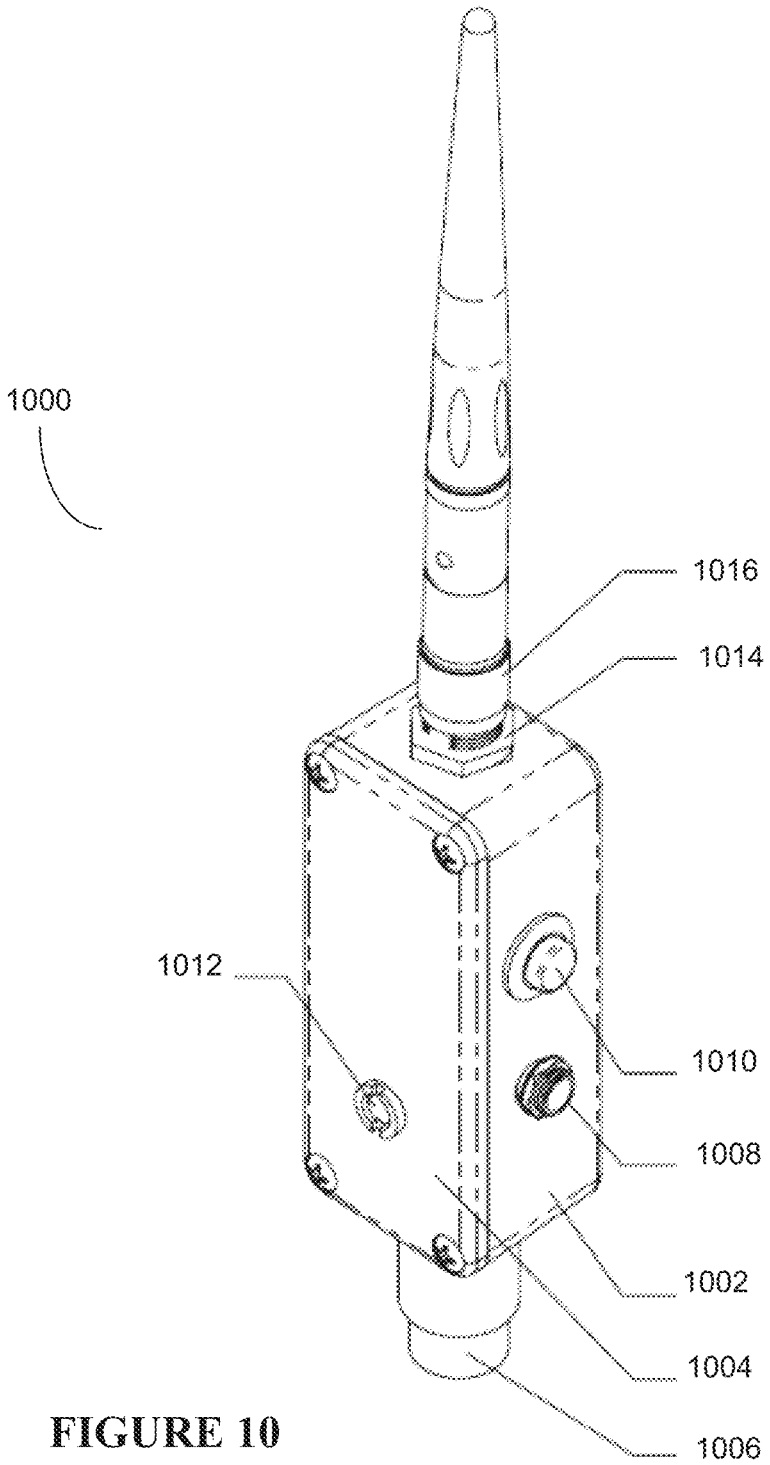
FIG. 10 is a perspective front view of the wireless transceiver device for controlling professional stage and movie lighting and effects.

FIG. 10 is a perspective front view of the wireless transceiver device 1000 for controlling professional stage and movie lighting and effects. The wireless transceiver device 1000 has housing or chassis 1002 and cover 1004 to protect the internal components of the device from weather or other damages. The internal components can provide impact protection to insulate the fragile electronic modules contained within the housing 1002.

In this embodiment, the adaptor 1006 is mounted on the bottom or the wireless transceiver device 1000. FIG. 10 illustrates an optional power connection 1008 and a wireless unlink button 1010 that can reset the operation of the wireless protocol. Other functions shown in FIG. 10 include a mounting collar 1012 for mounting industry standard hardware and a wireless connector 1014 for mounting the antenna 1016. The mounting collar 1012 may be installed into the chassis cover or the housing 1002. The mounting collar 1012 allows for standard mounting hardware connections to the chassis to maximize the flexibility of use. In one embodiment, the mounting collar 1012 may accept an industry standard "baby pin" mounting part. A traditional cable may be used to connect a host device to the wireless transceiver device as it may need to be mounted with any industry standard clamps in a position away from the host device to maximize wireless signal strength.

Figure 11:
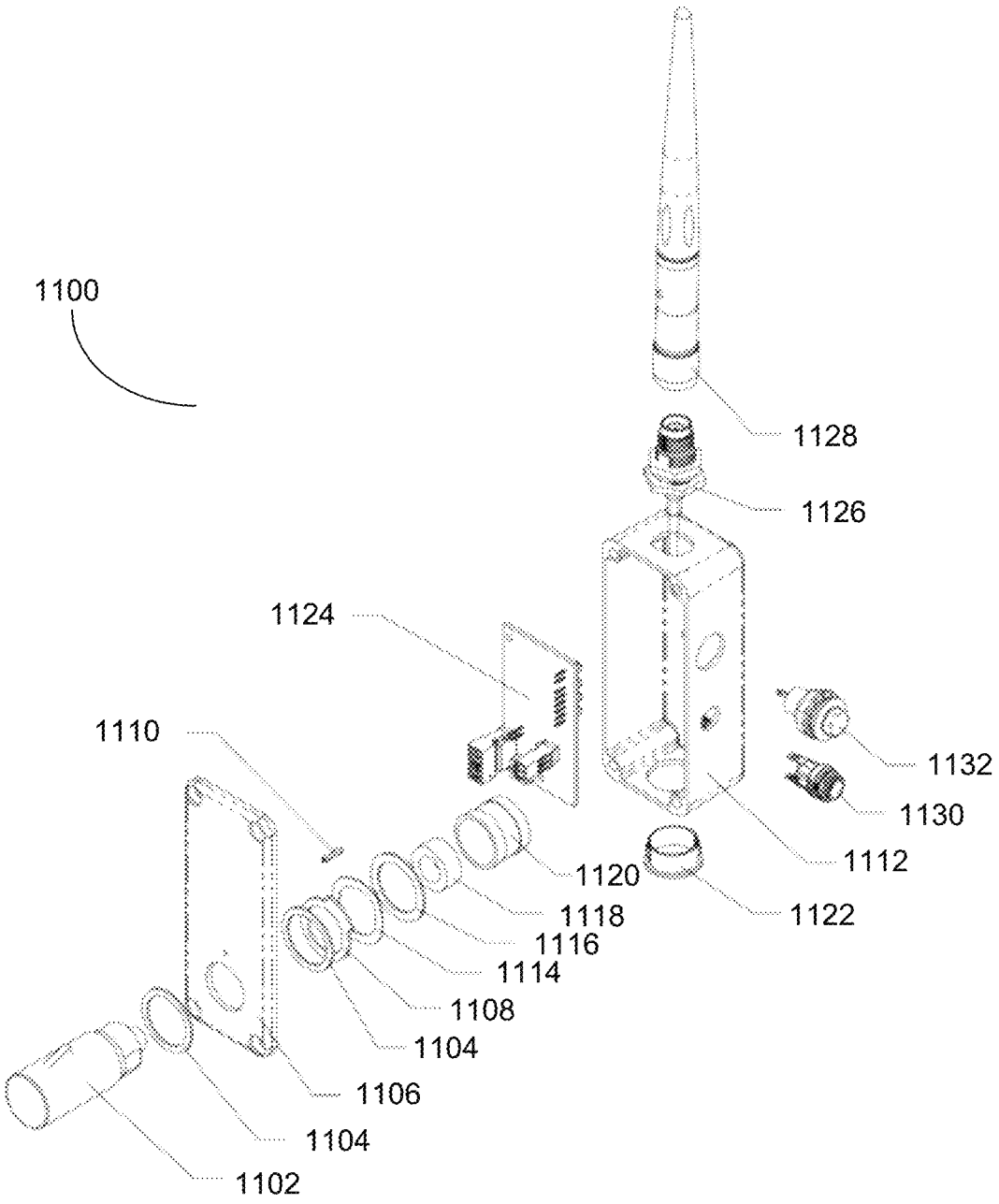
FIG. 11 is a perspective expanded parts view of the wireless transceiver device for controlling professional stage and movie lighting and effects.

FIG. 11 is a perspective expanded parts view of the wireless transceiver device for controlling professional stage and movie lighting and effects. The wireless transceiver device 1100 can include a rotating assembly for the interface connector 1102 that supports and allows for angular positioning around the axis of the interface connector adaptor 1102 after it is plugged into a host device (not shown). This subassembly may comprise two plastic or other low-friction material washers 1104 assembled onto the interface connector adaptor 1102 around the chassis cover 1106. These washers 1104 allow the interface connector adaptor 1102 to smoothly rotate in the chassis cover or housing 1106 with low applied torque from the user. The chassis cover 1106 rotates around a pivot point where the pivot point is an axis that bisects the interface connector adaptor 1102.

In one embodiment, on the interior and behind the washer 1104, a stop washer 40 is assembled to the DMX connector. This stop washer 1108, combined with the stop pin 1110 mounted to the cover 1106, acts to prevent the rotating interface connector assembly 1102 from moving freely around 360 degrees of rotation around the device 1100. For example, in one embodiment, the tab protruding from the stop washer 1108 may be designed such that only 270 degrees of rotation are possible before an edge of the tab comes in contact with the stop pin 1110 thus preventing further movement. Such a design can act to prevent excessive twisting and stress applied to the internal wiring of the device 1100.

The design specifies the location of the stop pin 1110 relative to the housing or chassis 1112 and stop washer as well as the size and shape of the stop washer 40 tab to meet rotational limitations as needed for each embodiment. A wave washer 1114 can be included in the assembly as can an insulating washer 1116. The wave washer 1114 can be compressed through spacer 1118 by threading and tightening the interface connector adaptor end cap 1120 onto the interface connector adaptor 1102 threaded end that passes through the cover 1106. The wave washer 1114 provides a spring force in the axial direction to maintain friction at the thread interfaces of the cap and connector thus preventing the assembly from loosening when it is rotated. A washer 1116 may be inserted into the assembly to provide compression for the wave washer 1114 that provides sufficient resistance to unwanted motion. While easily adjustable without specialized tools, the assembly can be made stiff enough to prevent unwanted rotation once connected.

An alternate embodiment may combine or eliminate some components of the rotation assembly while still maintaining the intent of rotation of the device around the axis of the rotating interface connector assembly 1102. In another embodiment of the rotating assembly components may allow for full 360 degree rotation around the rotating interface connector assembly 1102 axis through the use of a stator and communicator assembly or slip ring and brush component or other suitable contacts.

In alternate embodiments, the housing or chassis 1112 may allow for mounting the rotating interface connector assembly 1102 on either the chassis cover 1106 or the chassis itself. Also, the rotating interface connector assembly 1102 can be located on the bottom of the wireless transceiver device 1100 as previously shown. To optimize manufacturing flexibility and efficiency a rotating interface connector assembly 1102 mounting position hole may be present on both the chassis 1112 and cover 1106 with an optional hole plug 1122 installed in the unused hole upon assembly of the system.

The chassis 1112 provides location and mounting for a RF circuit board module 1124 inside the housing or chassis 1112. A wireless network antenna interface connector 1126 may be mounted to the housing or chassis 1112 or the cover 1106 in some embodiments. Alternate embodiment may have internal antennas. A removable and directionally adjustable wireless antenna 1128 is mounted to the antenna interface connector 1126. Also connecting to the RF circuit board or other electronic circuitry modules are a power connector 1130 and an optional wireless unlink button 1132.

The advantages of the invention include, without limitation, the ability to replace cabling used in a wide range of lighting and effects control applications. Reductions in cabling complexity and material cost, setup time and labor costs are benefits of the wireless transceiver device. A general design feature of the various embodiments of the wireless transceiver device is such that host device onto which the wireless transceiver is connected requires no modification, alteration or additional parts for full functionality.

Figure 12:
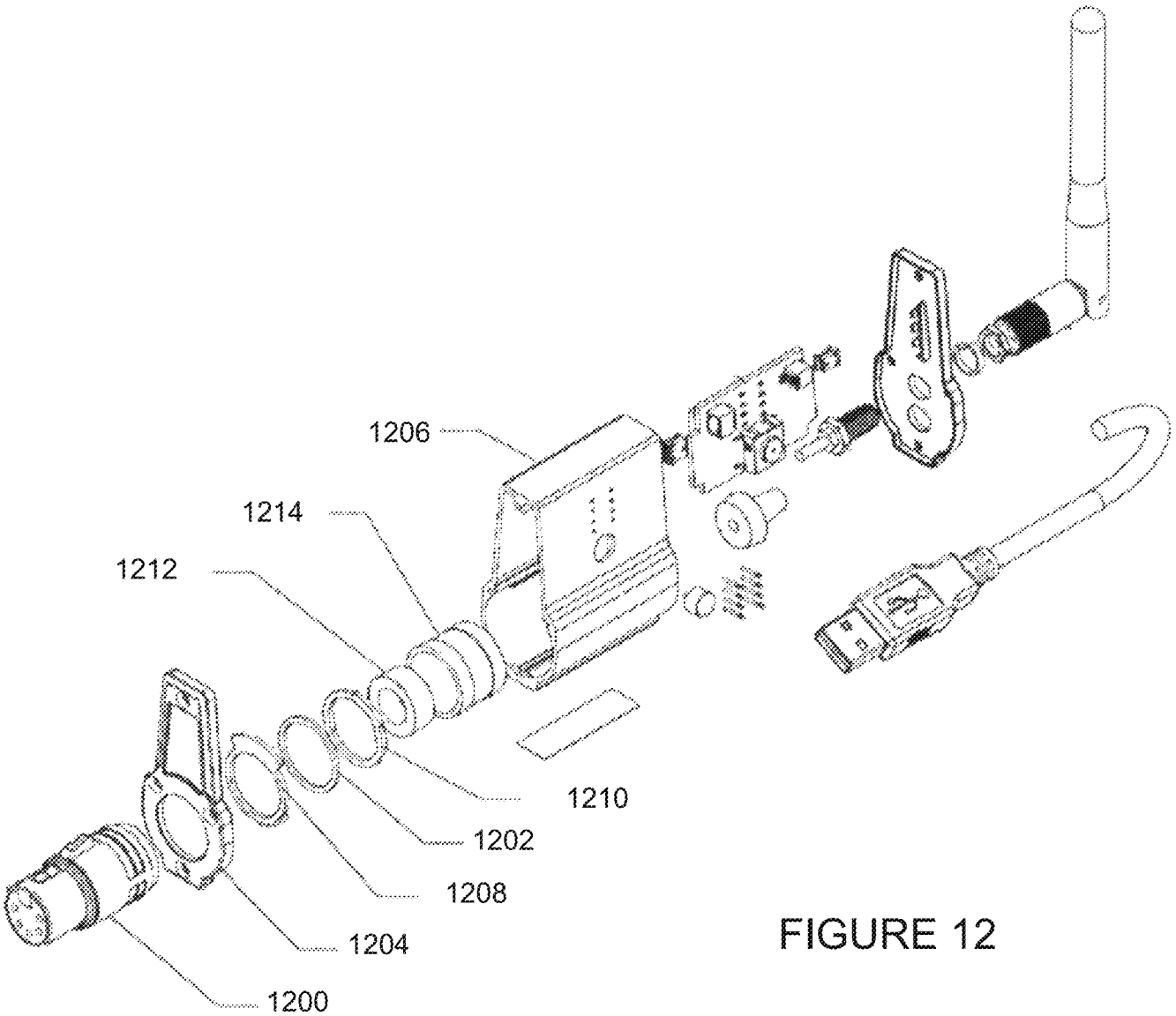
FIG. 12 is a perspective expanded parts view of another embodiment of the wireless transceiver device for controlling professional stage and movie lighting and effects.

FIG. 12 is a perspective expanded parts view of another embodiment of the wireless transceiver device for controlling professional stage and movie lighting and effects. The device includes a rotating assembly to allow for angular positioning around the axis of the DMX interface connector/interface adaptor 1200 after it is plugged into a host device. The subassembly may comprise one or more plastic or other low-friction material washer(s) 1202 assembled onto the DMX connector 1200 around the chassis 1204. These washer(s) allow the DMX connector 1200 to smoothly rotate in a chassis 1206 with low applied torque from the user. Thus, the chassis 1206 can rotate around a pivot point where an axis of the pivot point bisects the DMX connector 1200.

In one embodiment, on the interior and behind the washer(s) 1202, a stop pin washer 1208 is assembled and positioned adjacent to the DMX connector 1200. In alternate embodiments, the low friction washer(s) 1202 may be positioned behind the stop pin washer plate 1208. The stop pin washer plate 1208 may be combined with a rotation limiting washer 1210 and acts to prevent the rotating assembly from moving freely around 360 degrees of rotation.

For example, in one embodiment, the pin protruding from the stop pin washer plate 1208 may be designed such that less than 360 degrees of rotation is possible (e.g., 270, 180, or 90 degrees of rotation) before an edge of the tab feature on the contact rotation limiting washer contacts the pin and prevents further movement. The stop pin washer plate 1208 in turn may be designed to lock in place on a screw, pin, or protrusion in the lid or other such feature so it is prevented from turning. This is designed to prevent excessive twisting and stress applied to the wiring to the DMX connector 1200. The design specifies the location of the stop pin washer 1208 relative to the chassis 1206 as well as the size and shape of the rotation limiting washer 1210 tab to meet rotational limitations as needed for each embodiment. An electrically insulating washer may optionally be included in the assembly, followed by a spacer 1212 by threading and tightening the DMX connector end cap 1214 onto the DMX connector 1200 threaded end.

While easily adjustable without tools, the assembly can be made stiff enough to prevent unwanted rotation. In summary, the DMX connector rotating assembly comprises the connector 1200, one or two low-friction washers or bearings 1202, a stop pin washer 1208, a rotation limiting washer 1208, an optional insulating washer (not shown), a spacer 1212 and finally the DMX connector end cap 1214. An alternate embodiment may combine or eliminate some components while still maintaining the intent of rotation of the device around the axis of the DMX connector 1200.

The device includes a rotating assembly to allow for angular positioning around the axis of the DMX interface connector 1200 after it is plugged into a host device. This subassembly may comprise of one or two plastic or other low-friction material washers 1202 assembled onto the DMX connector 1200 around the chassis cover 1204. These washers allow the DMX connector to smoothly rotate in the chassis cover 1204 with low applied torque from the user. In one embodiment, on the interior and behind the low friction washer 1202, a stop pin washer 1208 is assembled to the DMX connector 1200.

In alternate embodiments, the low friction washer 1202 may be behind the stop pin washer 1208. The stop pin washer 1208 is combined with a rotation limiting washer 1210 and acts to prevent the rotating assembly from moving freely around a 360 degrees of rotation. For example, in one embodiment, the pin protruding from the stop pin washer 1208 may be designed such that only 270 degrees of rotation are possible before an edge of the tab feature on the contact rotation limiting washer contacts the pin and prevents further movement. The stop pin washer 1208 in turn may be designed to lock in place on a screw, pin, or protrusion in the lid or other such feature so it is prevented from turning. This is designed to prevent excessive twisting and stress applied to the wiring to the DMX connector. The design specifies the location of the stop pin washer plate 1204 relative to the chassis as well as the size and shape of the rotation limiting washer 1210 tab to meet rotational limitations as needed for each embodiment.

An electrically insulating washer may be optionally included in the assembly, followed by a spacer 1212 by threading and tightening the DMX connector end cap 1214 onto the DMX connector 1200 threaded end that passes through the chassis cover 1204. While easily adjustable without tools, the assembly is typically stiff enough to prevent unwanted rotation. In summary, the DMX connector rotating assembly comprises of the connector 1200, one or more low-friction washer(s) or bearings 1202, a stop pin washer 1208, a rotation limiting washer 1210, an optional insulating washer, a spacer 1212 and finally the DMX connector end cap 1214.

An alternate embodiment may combine or eliminate some components while still maintaining the intent of rotation of the device around the axis of the DMX connector. Another embodiment of the rotating assembly components may allow for full 360 degree rotation around the DMX connector axis through the use of, for example, a stator and commutator assembly, slip ring and brush components or other suitable contacts.

Another embodiment of the rotating assembly components may allow for full 360 degree rotation around the DMX connector axis through the use of, for example, a stator and commutator assembly, slip ring and brush components or other suitable contacts.

While various embodiments of the invention have been described, it will be apparent to those of ordinary skill in the art that many more embodiments and implementations are possible that are within the scope of this invention.

What is claimed is:

1. A wireless controller for lighting systems, comprising:

a radio transceiver module connected by a rotating assembly to an interface adaptor, wherein the rotating assembly enables rotation of the wireless controller relative to the interface adaptor around a pivot point, the interface adaptor being configured to form a removable cable connection between the wireless controller and an external host device controlled by the radio transceiver module such that the radio transceiver module communicates with the external host device via the removable cable connection formed by the interface adaptor;

a power connection, the power connection allowing a power source to be connected to the radio transceiver module; and an antenna in electronic communication with the radio transceiver module, the antenna configured to transmit and/or receive communications to and/or from a lighting system.

2. The wireless controller for lighting systems of claim 1, further comprising a housing for the radio transceiver module.

3. The wireless controller for lighting systems of claim 1, where the power connection receives power from a source external to the wireless controller.

4. The wireless controller for lighting systems of claim 1, where the rotating assembly further comprises a plurality of washers.

5. The wireless controller for lighting systems of claim 1, where the rotating assembly further comprises a stop washer and a stop pin to prevent rotation of the wireless controller to less than 360 degrees.

6. The wireless controller for lighting systems of claim 5, where the stop washer and the stop pin are made from a low friction material.

7. The wireless controller for lighting systems of claim 1, where the rotating assembly further comprises a stop washer plate adjacent to a rotation limiting washer.

8. The wireless controller for lighting systems of claim 1, where the pivot point bisects the interface adaptor.

9. A wireless controller for lighting systems, comprising:

a radio transceiver module connected by a rotating assembly to an adaptor, the rotating assembly enabling rotation of the wireless controller when the rotating assembly is coupled to the adaptor, the rotating assembly further comprising at least one rotation limiting washer and at least one stop pin washer, the adaptor being configured to form a removable cable connection between the wireless controller and an external host device controlled by the radio transceiver module such that the radio transceiver module communicates with the external host device via the removable cable connection formed by the adaptor;

a power connection, the power connection allowing a power source to be connected to the radio transceiver module; and an antenna in electronic communication with the radio transceiver module, the antenna configured to transmit and/or receive communications to and/or from a lighting system.

* * * * *